US006536384B1

(12) United States Patent
Keoppel

(10) Patent No.: US 6,536,384 B1
(45) Date of Patent: Mar. 25, 2003

(54) TWO-STROKE INTERNAL COMBUSTION ENGINE WITH ISOLATED CRANKCASE

(76) Inventor: Frank Keoppel, 461 S. Downs Dr., Ogden, UT (US) 84404

( * ) Notice: Subject to any disclaimer, the term of this patent is extended or adjusted under 35 U.S.C. 154(b) by 0 days.

(21) Appl. No.: 09/557,455

(22) Filed: Apr. 24, 2000

(51) Int. Cl.[7] ..... F02M 35/10
(52) U.S. Cl. ..... 123/70 R
(58) Field of Search ..... 123/70 R

(56) References Cited

U.S. PATENT DOCUMENTS

| | | | | |
|---|---|---|---|---|
| 3,672,172 A | | 6/1972 | Hammond | 60/282 |
| 3,834,364 A | | 9/1974 | Bartholomew | 123/119 |
| 4,248,185 A | | 2/1981 | Jaulmes | 123/73 R |
| 4,558,671 A | | 12/1985 | Stinebaugh | 123/317 |
| 4,598,673 A | | 7/1986 | Poehlman | 123/73 |
| 5,005,537 A | | 4/1991 | Maissant | 123/65 |
| 5,027,758 A | | 7/1991 | Siegler | 123/73 |
| 5,154,141 A | | 10/1992 | McWhorter | 123/21 |
| 5,230,314 A | | 7/1993 | Kawahara et al. | 123/317 |
| 5,279,269 A | | 1/1994 | Aizawa et al. | 123/317 |
| 5,291,866 A | | 3/1994 | Kosa | 123/317 |
| 5,347,967 A | | 9/1994 | Todero et al. | 123/317 |
| 5,403,164 A | * | 4/1995 | Gama | 123/70 R |
| 5,490,482 A | | 2/1996 | Genet | 123/47 |
| 5,526,778 A | * | 6/1996 | Springer | 123/70 R |
| 5,579,735 A | | 12/1996 | Todero et al. | 123/317 |
| 5,588,402 A | * | 12/1996 | Lawrence | 123/65 P |
| 5,657,724 A | | 8/1997 | Brown et al. | 123/73 |
| 5,678,525 A | | 10/1997 | Taue | 123/73 A |
| 5,682,845 A | | 11/1997 | Woody | 123/73 |
| 5,752,477 A | | 5/1998 | Dabadie | 123/65 |
| 5,809,949 A | | 9/1998 | Duret | 123/65 |

FOREIGN PATENT DOCUMENTS

| | | |
|---|---|---|
| JP | 57102519 A | 6/1982 |
| JP | 58085320 A | 5/1983 |
| JP | 60013968 A | 1/1985 |
| JP | 61093231 A | 5/1986 |
| JP | 63179130 A | 7/1988 |
| JP | 2231292 A | 9/1990 |
| JP | 7317547 A | 12/1995 |
| JP | 7317550 A | 12/1995 |
| JP | 7317551 A | 12/1995 |
| JP | 7317552 A | 12/1995 |

* cited by examiner

*Primary Examiner*—Noah P. Kamen
*Assistant Examiner*—Jason Benton
(74) *Attorney, Agent, or Firm*—R. Reams Goodloe, Jr.

(57) ABSTRACT

A two-stroke engine with an isolation chamber. The isolation chamber has a pressure-sensitive wall attached to or slidably mounted within the isolation chamber. The pressure-sensitive wall is substantially impervious to air, oil, and the fuels used in an internal combustion two-stroke engine. When the piston of the engine moves away from the crankcase, a vacuum is created in the crankcase. This draws the pressure-sensitive wall toward the crankcase within the fluid communication circuit, which movement of the pressure sensitive wall also pulls air into the intake side of the isolation chamber through a one-way valve or time induction mechanism. When the piston moves toward the crankcase, the increased pressure within the crankcase forces the pressure-sensitive wall away, fluidwise, from the crankcase and thus pushing air from the isolation chamber into the combustion chamber. The pressure-sensitive wall therefore is effective in preventing oil from flowing into the combustion chamber from the crankcase. Further, a modified piston having a lower oil ring precludes oil from being pushed by pressurized air from leaving the crankcase, squeezing past the piston, and reaching the transfer port and the exhaust port. Consequently, pollution is minimized in a two-stroke engine utilizing this novel design approach.

30 Claims, 4 Drawing Sheets

TWO-STROKE INTERNAL COMBUSTION ENGINE WITH ISOLATED CRANKCASE

BACKGROUND OF THE INVENTION

1. Field of the Invention

This invention relates to a two-stroke internal combustion engine, especially such an engine with a pressure-sensitive wall contained within a chamber for isolating the crankcase from the combustion chamber.

2. Description of the Related Art

In a conventional two-stroke internal combustion engine, the vacuum caused by a piston moving away from the crankcase draws a mixture of fuel, air, and oil into the crankcase through a one-way valve or timed induction mechanism such as a piston port or rotary valve. Increased pressure produced by the piston moving toward the crankcase forces the mixture of fuel, air, and oil into the piston cylinder on the side of the piston away from the crankcase and, therefore, into the combustion chamber, which is at the portion of the piston cylinder that is the most distant from the crankcase, because such carbureted fuel cannot escape through the one-way valve or a now closed induction mechanism.

The crankcase is used as a compressor. This requires the crankcase to have relatively close tolerances between the crank and the crankcase, itself. It is also required that the crankcase be sealed. These factors isolate the crankcase from any lubrication that may be in other parts of the engine. Therefore, a secondary lubrication system is necessary. However, any oil in the crankcase would readily be pushed into the combustion chamber. Therefore, to minimize the oil that is pushed into the combustion chamber, oil is continuously added to the crankcase, but only in small quantities. In conventional two-stroke engines this is accomplished either by oil injection or by utilizing fuel which has been pre-mixed with a suitable quantity of oil. But no matter how the lubrication is achieved, oil will be introduced into the combustion chamber and combusted. And during the combustion process, such oil creates considerable smoke and other pollution.

Additionally, when a traditional two-stroke internal combustion engine compresses the mixture of fuel, air, and oil (before the transfer ports open), some of the fuel and oil can go past the piston skirt and into the exhaust port unburned. This adds to hyrocarbon pollution of the atmosphere and limits the attainable crankcase pressure.

U.S. Pat. No. 4,248,185 of Eric Jaulmes employs a membrane 7 in the crankcase pump 1 of a two-cycle engine, but the sole purpose of that membrane 7 is to divide the crankcase pump 1 into two chambers 8 and 9. Chamber 8 contains the crankshaft 6 and the connecting rod 4 and would, therefore, also contain oil for lubrication. Since carbureted air passes through chamber 8 on its way to the piston cylinder 2, oil (whether pre-mixed with fuel or injected into the crankcase) would thereby be introduced into the piston cylinder 2. Pure air passes through chamber 9 to reach the piston cylinder 2; but because of the oil-containing carbureted air, the membrane 7 does not isolate the piston cylinder 2 from the oil in the crankcase. In the alternate embodiment of FIGS. 7 through 9, the carbureted air passes through chamber 9; and pure air goes through chamber 8. Thus, as explained in lines 25 through 28 of column 4, it is necessary to provide separate lubrication, i.e., lubrication could not be accomplished by oil pre-mixed with the fuel. The oil that would be separately added for lubrication would then travel with the air to the piston cylinder 2.

U.S. Pat. No. 5,291,866 of David R. Kosa applies to a Pulse Charger 40 which supplies air from the crankcase 24 of a four-cycle internal combustion engine to the intake system 18 of that engine. It is asserted that a baffle 120 between the crankcase 24 and the pulse charger 40 "aids in keeping any liquid from entering" the pulse charger and that an "additional oil separator 140 . . . may also be included in order to separate crankcase oil from the pulsed air charge prior to the pulsed air charge entering carburetor or fuel injection system 52 [which carburetor or fuel injection system 52 is placed between the pulse charger 40 and the intake system 18]. Oil separator 140 can be of the centrifugal type, the baffle type or any other type of separator known in the art." The baffle 120 and oil separator 140, however, attempt to remove oil from air which such oil has already infiltrated rather than precluding such oil from ever entering the air.

The supercharger in U.S. Pat. No. 3,672,172 of Gary L. Hammond appears to operate in a fashion rather similar to that of U.S. Pat. No. 5,291,866. "To avoid any undesired entrainment of oil in the supercharging air, an air-oil separator such as, for example, louvered baffle, wire mesh screen, loose packed metal shavings or the like, or combinations thereof, is employed [between the crankcase 26 or 122 and the inlet valve 12 or intake port 104]. The separator should not unduly restrict airflow but should trap entrained oil." In attempting to remove oil from air which such oil has already infiltrated rather than precluding such oil from ever entering the air, the devices of U.S. Pat. Nos. 5,291,866 and 3,672,172 do, however, necessarily limit airflow.

Some two-stroke internal combustion engines avoid introducing oil into the carbureted air by not using the crankcase as a pump. Instead, these engines utilize superchargers, which are heavy, expensive, and inefficient because the blower is always turning and putting a load on the engine even when there is no demand from the engine for fuel or air, i.e., when the transfer ports are closed.

SUMMARY OF THE INVENTION

The present invention utilizes the pressure and vacuum cycles created within the crankcase of a crankcase compression two-stroke internal combustion engine to force air into the piston cylinder, also termed the combustion chamber, of the engine. A flexible diaphragm, bellows, or floating piston is, though, utilized to isolate the air that travels to the combustion chamber from the crankcase. Therefore, no oil ever enters the combustion chamber.

As the piston moves away from the crankcase, a vacuum is created within the crankcase. This draws the flexible diaphragm, bellows, or floating piston within an isolation chamber toward the crankcase, creating a vacuum on the side of the diaphragm, bellows, or floating piston away from the crankcase and drawing a mixture of fuel and air (or plain air if either a fuel injection system that injects fuel into the combustion chamber is utilized or a charge former is between the isolation chamber and the transfer port) through a one-way valve or timed induction mechanism into the isolation chamber on the side of the diaphragm, bellows, or floating piston that is away from the crankcase.

When the piston moves toward the crankcase, the increased pressure pushes the diaphragm, bellows, or floating piston in the isolation chamber away from the crankcase. Because the mixture of fuel and air or pure air on the side of the diaphragm away from the crankcase cannot escape through the one-way valve or timed induction mechanism, such mixture of fuel and air or pure air is forced into the piston cylinder and, therefore, into the combustion chamber.

Such mixture of fuel and air or pure air is, therefore, pumped into the combustion chamber without ever being exposed to oil that lubricates the crankcase and without the use of a supercharger.

Preferably, the piston is designed with a full-length skirt around the entire perimeter of the piston and with at least one ring around the piston. This ring is placed so that it is always between all ports and the crankcase in order to preclude oil that is either maintained within and/or circulated through the crankcase from passing between the piston and the wall of the piston cylinder and thereby entering the exhaust port or the transfer port. (Oil in the exhaust port would be heated to such an extent that it would smoke or be pushed into the surrounding environment; oil in the transfer port would be pushed into the combustion chamber and create smoke during combustion which would then be exhausted to the surrounding environment.)

DESCRIPTION OF THE PREFERRED EMBODIMENT

Figure 1:
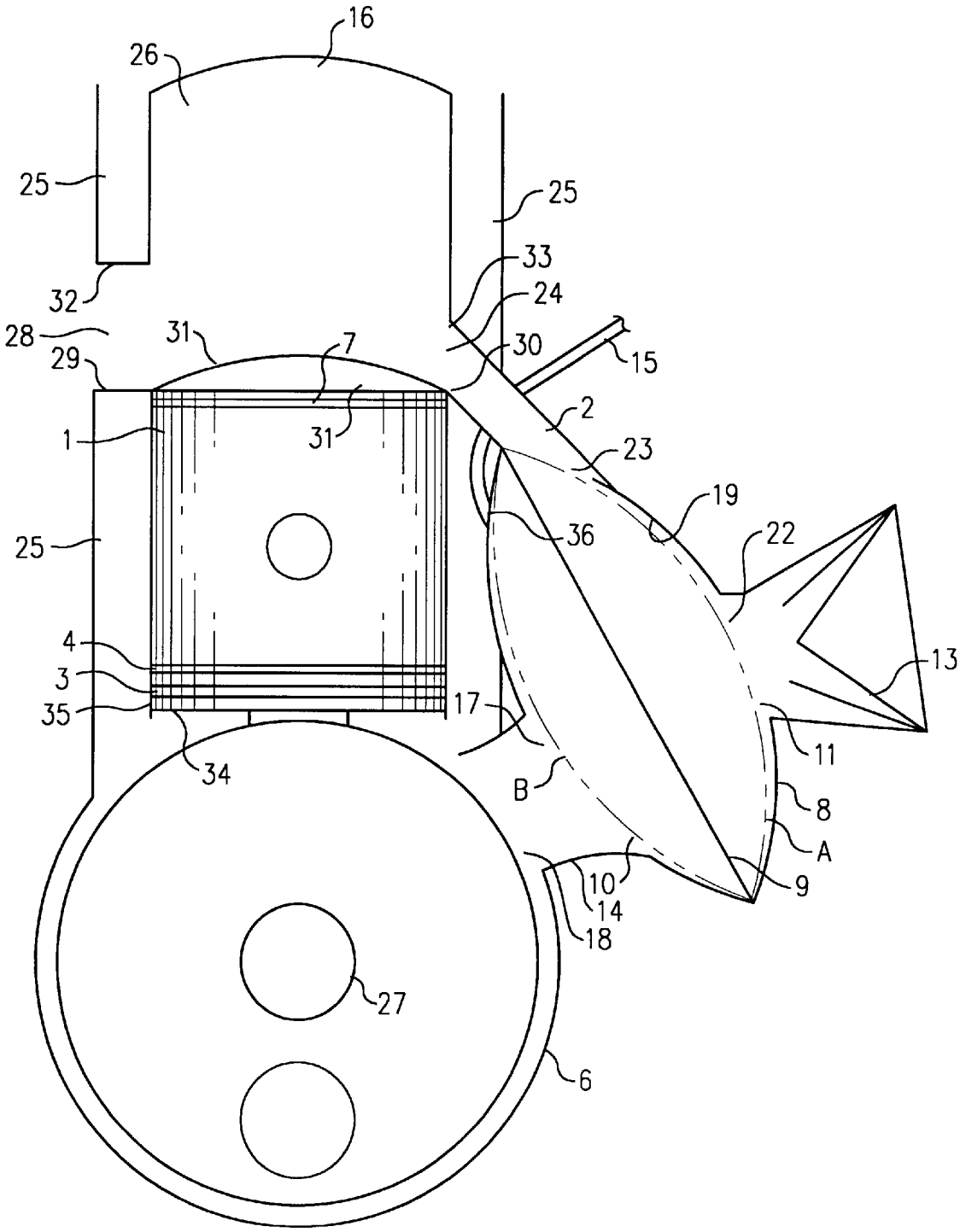
FIG. 1 illustrates the Two-stroke Engine with Isolated Crankcase utilizing a diaphragm as the pressure-sensitive wall.
Figure 2:
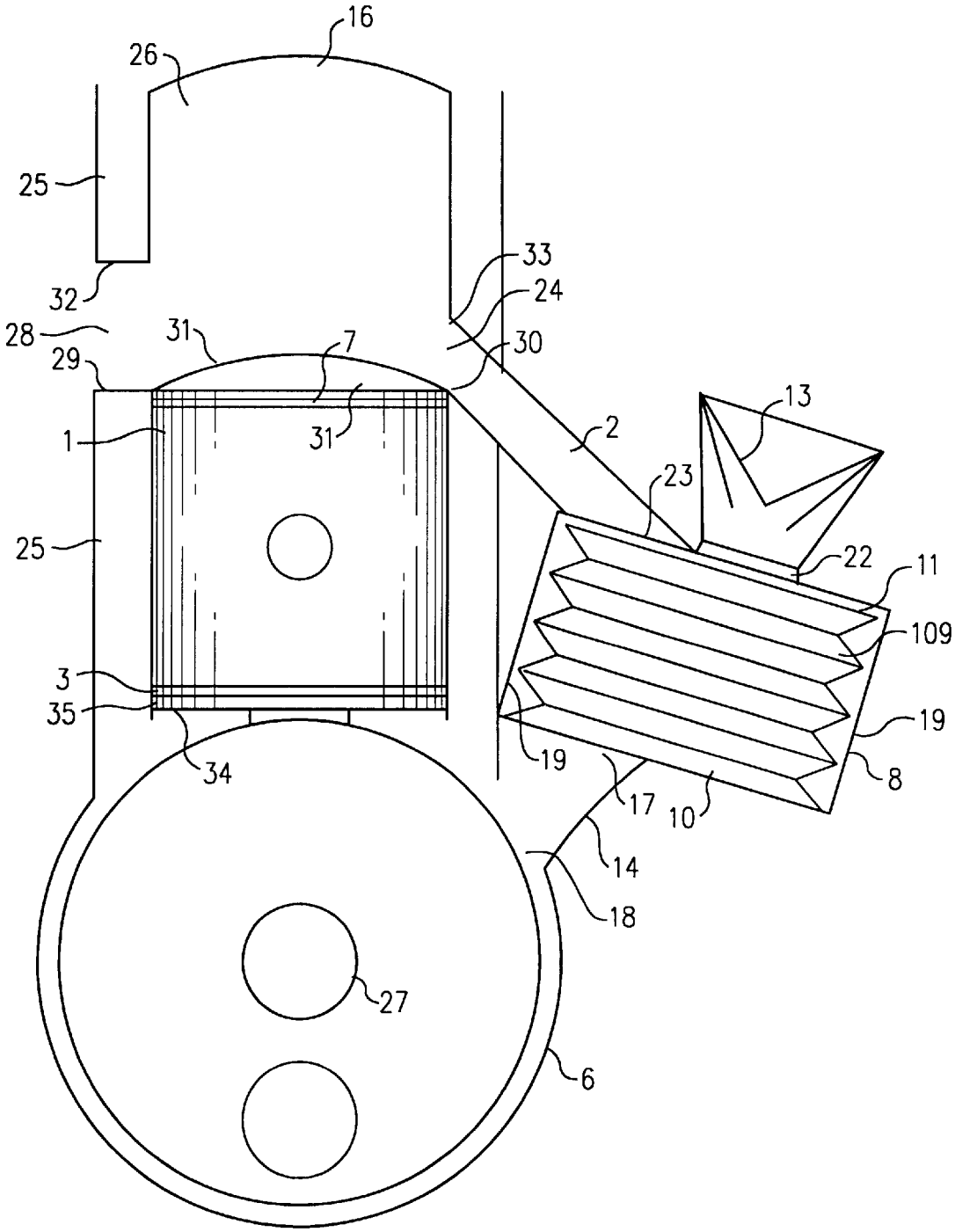
FIG. 2 portrays the Two-stroke Engine with Isolated Crankcase employinging a bellows as the pressure-sensitive wall.
Figure 3:
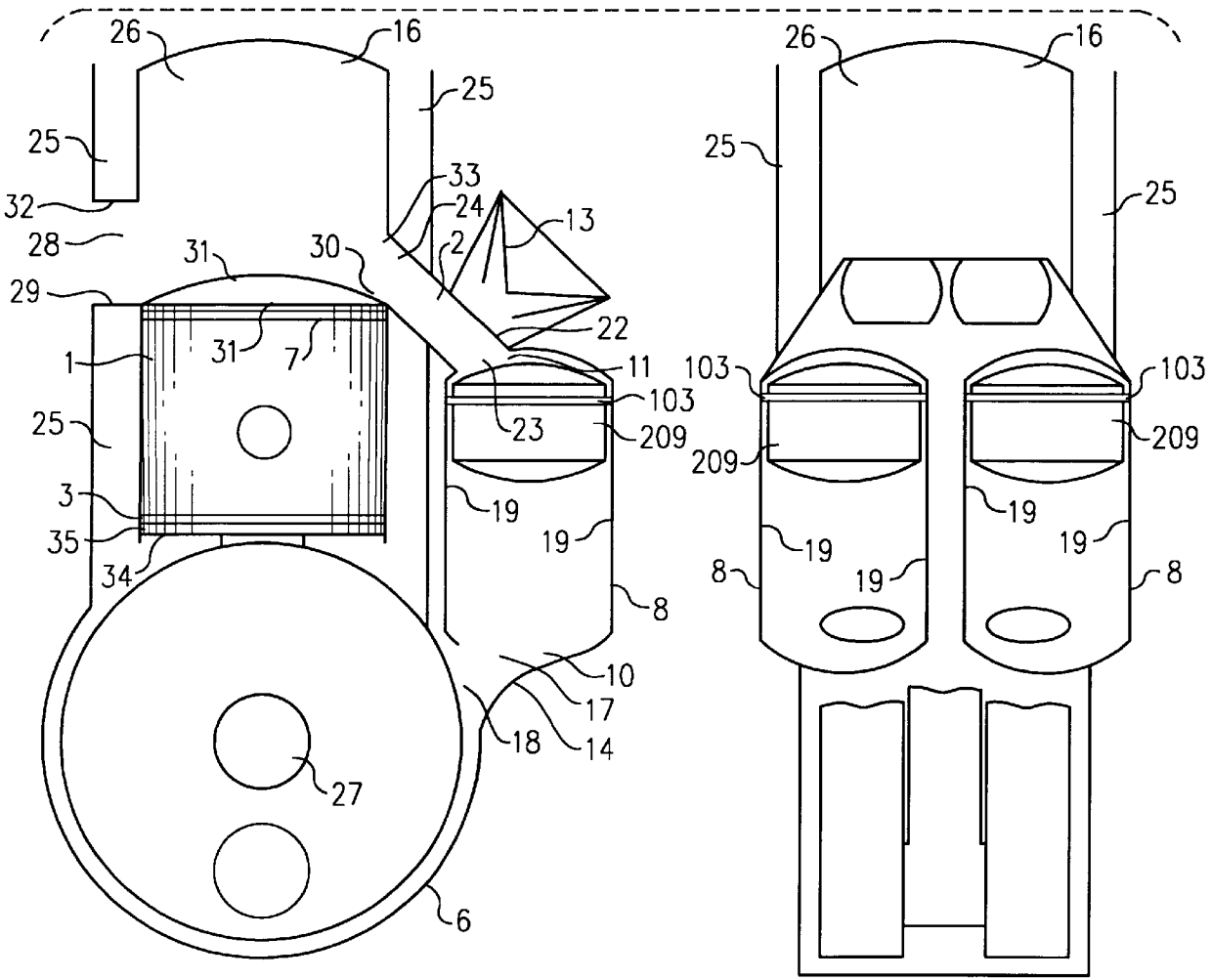
FIG. 3 shows the Two-stroke Engine with Isolated Crankcase using a floating piston as the pressure-sensitive wall.

As illustrated in FIG. 1, the preferred embodiment of the Two-stroke Engine with Isolated Crankcase primarily adds to the components of a traditional two-stroke internal combustion engine an isolation chamber 8 having a pressure-sensitive wall. The pressure-sensitive wall may be a flexible diaphragm 9 as illustrated in FIG. 1, a bellows 109 as portrayed in FIG. 2, or a floating piston 209 as shown in FIG. 3.

The isolation chamber 8 is attached to a sealed crankcase 6 and communicates with the crankcase 6 through an aperture termed the crankcase-side aperture 17 in the isolation chamber 8 and an aperture 18 in the crankcase 6. Preferably, a hollow member termed the activation passage 14 is used to connect the isolation chamber 8 to the crankcase 6.

The pressure-sensitive wall is substantially impervious to air, oil, and the fuels used in an internal combustion engine and, with the inner surface 19 of the isolation chamber 8, forms a barrier that is substantially impervious to air, oil, and the fuels used in an internal combustion engine. When a diaphragm 9 or a bellows 109 is utilized, the diaphragm 9 or bellows 109 is attached to the inner surface 19 of the isolation chamber 8 in such a manner that oil and air cannot pass from the side termed the crankcase side 10 of the isolation chamber 8 that is toward the crankcase 6 to the side termed the intake side 11 of the isolation chamber 8 that is away from the crankcase 6. Preferably, the diaphragm 9 is attached near the center of the isolation chamber whereas the bellows 109 is attached near the crankcase-side aperture 17. The floating piston 209 is slidably in contact with the inner surface 19 of the isolation chamber 8 so that neither oil nor air can pass between the floating piston 209 and the inner surface 19 of the isolation chamber 8. This can be accomplished with a floating piston seal 103 which can be a flared or flared and flexible rim 103 that is an integral part of the floating piston 209; a ring, termed a piston ring, 103; or any other form of seal that is well known in the art.

The ring 103 is preferably a pressure ring. The floating piston 209 is preferably nonmetallic, e.g., carbon fiber or nylon, which is beneficially lighter than a metallic piston 209. This is possible because the pressure, heat, and quantity of oil to which the floating piston 209 is exposed are considerably lower than the pressure, heat, and quantity of oil to which the piston 1, discussed below, is subject.

Attachment of the diaphragm 9 or the bellows 109 to the isolation chamber 8 could, e.g., be done with an adhesive or, alternatively, through, friction if the isolation chamber 8 is split in half and clamped together with a portion of the diaphragm 9 or the bellows 109 inserted between the halves of the isolation chamber 8.

A second aperture termed the intake aperture 22 in the isolation chamber 8 is on the intake side 11 of the isolation chamber 8. Connected to the isolation chamber 8 and communicating with the isolation chamber 8 through the intake aperture 22 is a flow regulator. The flow regulator can be either a one-way valve 13 that permits air to pass into, but not escape from, the intake side 21 of the isolation chamber 8 or a timed induction mechanism, such as a rotary valve, that is open when the piston 1 of the engine is moving away from the crankcase 6 but closed when the piston 1 of the engine is moving toward the crankcase 6 so that air will flow into, but not escape from, the intake side 21 of the isolation chamber 8.

A third aperture 23 is located in the intake side 11 of the isolation chamber 8. Also, an aperture designated the transfer port 24 exists in the wall 25 of a piston cylinder 26, which piston cylinder is attached to the crankcase 6. The isolation chamber 8 is attached to the wall 25 of the piston cylinder 26 in such a manner that the isolation chamber 8 communicates with the piston cylinder 26 and, therefore, with the combustion chamber 16, which is at the portion of the piston cylinder 26 that is the most distant from the crankcase 6, through the third aperture 23 and the transfer port 24. Preferably the isolation chamber 8 is connected to the wall 25 of the piston cylinder 26 with a hollow member termed the transfer passage 2.

A piston 1 is slidably mounted within the piston cylinder 26 and is connected, as is well known in the art, to the crankshaft 27.

Also in the wall 25 of the piston cylinder 26 is an additional aperture termed an exhaust port 28. The top 32 of the exhaust port 28 is higher than the top 33 of the transfer port 24 so that, on the movement of the piston 1 toward the crankcase 6, the top 31 of the piston 1 will reach the top 32 of the exhaust port 28 before reaching the top 33 of the transfer port 24 to facilitate the movement of combustion gases from the combustion chamber 16 through the exhaust port 28.

Although for purposes of clarity of illustration only a single third aperture 23 of the isolation chamber 8, a single transfer port 24 in the wall 25 of the piston cylinder 26, and a single transfer passage 2 are shown, it is preferable to have multiple transfer ports 24 and multiple transfer passages 2 so as to enhance the efficiency in the scavenging of exhaust gases.

Carbureted air can be fed into the flow regulator, carburetion can occur between the isolation chamber 8 and the transfer port 24, or fuel can be injected into the combustion chamber 16.

The piston 1 has a means for precluding oil pushed by pressurized air from leaving the crankcase 6 and reaching the transfer port 24 and the exhaust port 28 by passing between the piston 1 and the wall 25 of the piston cylinder 26. The bottom 34 of the piston 1 must have a full-length skirt 35 around the entire perimeter of the piston 1. A piston seal 3, which is preferably an oil ring 3 but which can be a flared or flared and flexible rim must be around the piston 1 sufficiently close to the bottom 34 of the piston that the piston seal 3 is always between the crankcase 6 and the bottoms 29, 30 of the exhaust port 28 and the transfer port 24.

At least one traditional pressure or compression ring 7 is also located around the piston 1 near the top 31 of the piston 1; and, preferably, a pressure or compression ring 4 is placed around the piston 1 above and near the piston seal 3.

As can be understood from the preceding discussion, the pressure-sensitive wall, i e., the diaphragm 9, the bellows 109, or the floating piston 209 isolates the oil within the crankcase 6 from the combustion chamber 16.

As the piston 1 moves away from the crankcase 6, the pressure is decreased within the crankcase 6, thereby, when a diaphragm 9 is utilized, drawing the diaphragm 9 toward the crankcase so that, when the piston 1 has reached its upper limit of travel, the diaphragm 9 is approximately in position B, as shown in the ghost illustration of FIG. 1. (Similarly, if a bellows 109 were used, the closed end of the bellows 109 would be drawn toward the crankcase 6; and if a floating piston 209 were employed, the piston would be pulled toward the crankcase 6.) This naturally draws air through the flow regulator, preferably the one-way valve 13, and the intake aperture 22 into the intake side 11 of the isolation chamber 8. Then, the movement of the piston 1 toward the crankcase 6, increases the pressure within the crankcase 6, thereby pushing the diaphragm 9 (or the closed end of the bellows 109 or the floating piston 209) away from the crankcase 6 so that, when the piston 1 has reached its lower limit of travel, the diaphragm 9 is approximately in position A, as depicted in the ghost illustration of FIG. 1.

Because the air on the intake side 11 of the diaphragm 9 (or the bellows 109 or the floating piston 209) cannot escape through the flow regulator, preferably the one-way valve 13, such air is forced into the combustion chamber 16.

But since temperature changes within the crankcase 6 can interfere with the synchronization of movement between the piston 1 and the diaphragm 9 (or the bellows 109 or the floating piston 209), it is preferable to have a vent aperture 36 within the isolation chamber 8, the crankcase 6, or the activation passage 14 on the crankcase side 10 of the pressure-sensitive wall, which vent aperture 36 communicates between the surrounding environment and the isolation chamber 8, the crankcase 6, and the activation passage 14. This is accomplished by having the vent tube 15 attached to a vent aperture 36, which vent aperture can be in the crankcase side 10 of the isolation chamber 8, the crankcase 6, or the activation passage 14. Furthermore, to minimize the possibility of any contamination entering the vent aperture 36, it is preferable to have a hollow vent tube 15 attached to the isolation chamber 8, the crankcase 6, or the activation passage 14 around the vent aperture 36. The vent tube 15 communicates with, and leads away from, the vent aperture 36. Optionally, a filter can be placed on the end of the vent tube 15 that is away from the vent aperture 36.

Because of the sealed nature of the crankcase 6, if the temperature within the crankcase 6 increases rapidly as the piston 1 begins to travel upward, the diaphragm 9 (or the bellows 109 or the floating piston 209) will not begin moving toward the crankcase 6 immediately when the piston 1 begins to move away from the crankcase 6. Similarly, if the temperature within the crankcase 6 decreases rapidly as the piston 1 begins its movement toward the crankcase 6, the diaphragm 9 (or the bellows 109 or the floating piston 209) will not begin moving away from the crankcase 6 immediately when the piston 1 begins to move toward the crankcase 6.

The vent aperture 36 is selected to have a diameter of such a size that the vent aperture 36 will eliminate the delay in movement of the diaphragm 9 (or the bellows 109 or the floating piston 209) produced by temperature changes within the crankcase 6 while not permitting such a quantity of air to enter or leave the crankcase side 10 of the isolation chamber 8, the crankcase 6, or the activation passage 14 that the action of the diaphragm 9 (or the bellows 109 or the floating piston 209) would be impeded to such an extent that performance of the engine would be negatively measurably affected.

Optionally, through any means that is well known in the art, the vent aperture 36 can be coordinated with the engine speed, e.g., the vent tube 36 can be closed when the throttle is closed and also when the engine is operating at very high speeds.

Air introduced into the combustion chamber 16 through the pumping action of the diaphragm 9 (or the bellows 109 or the floating piston 209) not only provides the air for combustion, but also scavenges the exhaust products of combustion through the exhaust port 28.

Although only a single piston cylinder 26 has been illustrated, an isolation chamber 8 can similarly successfully be employed with multiple cylinder two-stroke engines because the portions of the crankcase 6 associated with a given piston cylinder 26 would be sealed from and, therefore, would not communicate with one another. In such a case, each piston cylinder 26 would have its own isolation chamber 8.

Also, rather that using just one isolation chamber 8, it would be possible to use multiple isolation chambers 8 for a given piston cylinder 26.

As another option, if all pistons 1 of a multiple-cylinder two-stroke engine fire at substantially the same time, a single isolation chamber 8 can communicate with all the piston cylinders 26; and it would not be necessary to have the portions of the crankcase 6 associated with different piston cylinders 26 sealed from one another.

Figure 4:
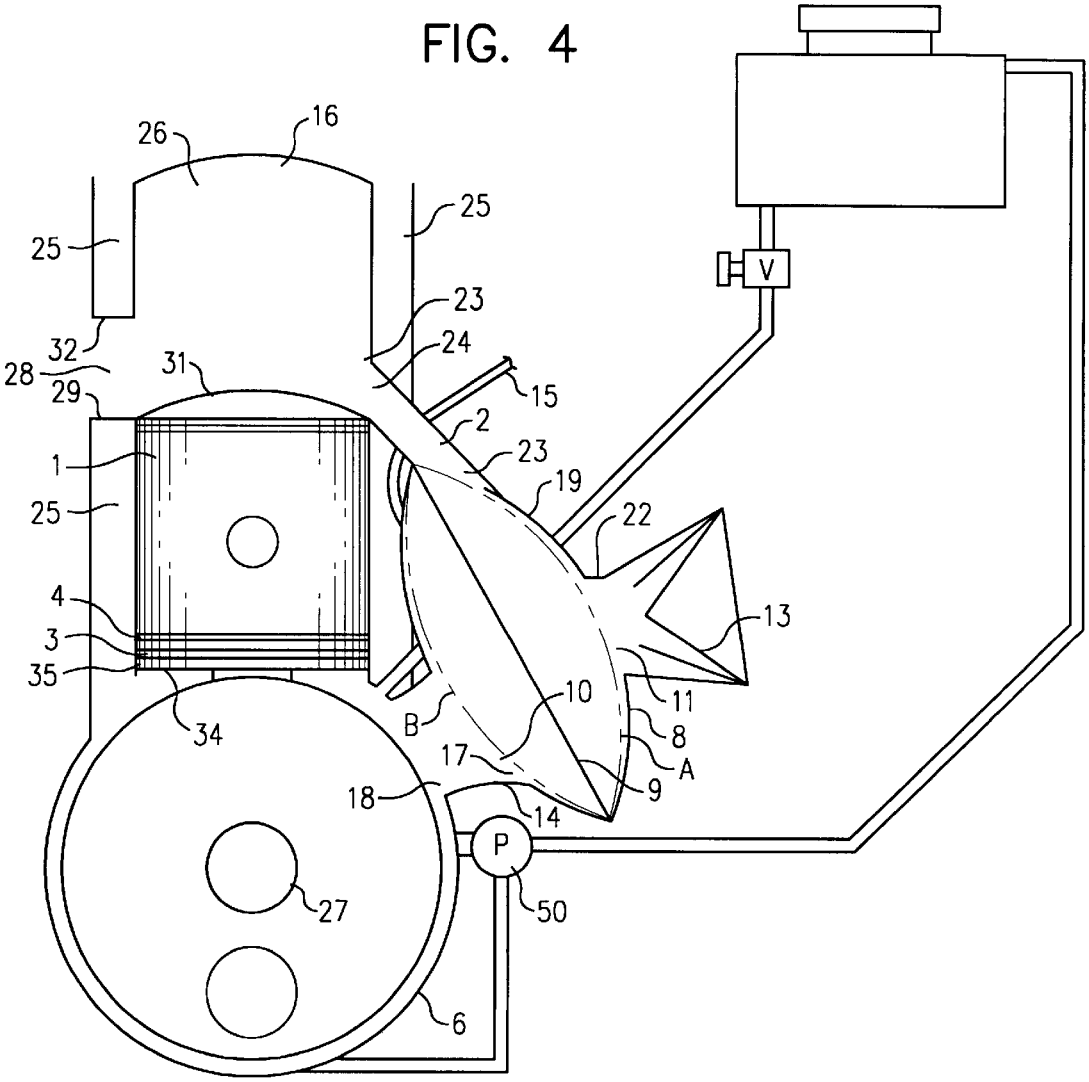
FIG. 4 depicts the embodiment of FIG. 1 wherein oil is circulated through the crankcase by a pump.

Oil can either be held within the crankcase 6 or, as illustrated in fig. 4, circulated through the crankcase 6 by any means that is well known in the art for conventional four-stroke engines, such as by a pump 50.

I claim:

1. A two-stroke internal combustion engine with isolated crankcase, which comprises:

a sealed crankcase having an aperture and a crankshaft;

a piston cylinder attached to said crankcase, said piston cylinder having a combustion chamber and also having a wall with a transfer port which has a top and a bottom and an exhaust port that has a top and a bottom with the top of the exhaust port being higher than the top of the transfer port;

a piston slidably mounted within said piston cylinder, said piston connected to the crankshaft of said crankcase, and having a top, a bottom a piston seal around said piston sufficienty close to said bottom of said piston that said piston seal is always between (1) said crankcase and (2) the bottoms of the transfer port and of the exhaust port, and a pressure ring located around said piston near the top of said piston;

an isolation chamber, said isolation chamber having an inner surface, a crankcase side, an intake side, a pressure-sensitive wall, said pressure-sensitive wall forming a barrier between said crankcase side and said intake side, and being substantially impervious to air, oil, and the fuels used in an internal combustion engine, a crankcase-side aperture on the crankcase side of said isolation chamber, an intake aperture on the intake side of said isolation chamber, and a third aperture on the intake side of said isolation chamber, said isolation chamber communicating with said crankcase through the crankcase-side aperture and the aperture in said crankcase, and said isolation chamber communicating with said piston cylinder through the third aperture and the transfer port; and a flow regulator connected to said isolation chamber and communicating with said isolation chamber through the intake aperture so that air may pass into, but will not escape outward through said flow regulator from, the intake side of said isolation chamber.

2. The two-stroke internal combustion engine with isolated crankcase as recited in claim 1, wherein:

on the crankcase side of said pressure-sensitive wall, an element of the engine selected from the group consisting of (a) the isolation chamber, and (b) the crankcase, contains a vent aperture, said vent aperture communicating between the surrounding environment and said engine element, said vent aperture having a diameter of such a size that said vent aperture eliminates delay in movement of said pressure-sensitive wall produced by temperature changes within said crankcase, while not permitting such a quantity of air to enter or leave said crankcase that the action of the pressure-sensitive wall would be impeded to such an extent that performance of the engine would be measurably negatively affected.

3. The two-stroke internal combustion engine with isolated crankcase as recited in claim 2, further comprising:

a hollow vent tube attached around, communicating with, and leading away from said vent aperture.

4. The two-stroke engine with isolated crankcase as recited in claim 3, wherein:

said isolation chamber is connected to said crankcase via an activation passage; and said isolation chamber is connected to the wall of said piston cylinder with a transfer passage.

5. The two-stroke internal combustion engine with isolated crankcase as recited in claim 3, wherein:

the group from which the element of the engine containing the vent aperture is selected further consists of an activation passage.

6. The two-stroke internal combustion engine with isolated crankcase as recited in claim 5, further comprising:

a hollow vent tube attached around, communicating with, and leading away from the vent aperture in said activation passage.

7. The two-stroke internal combustion engine with isolated crankcase as recited in claim 6, further comprising:

a pressure ring placed around said piston at a location above and near the said piston seal.

8. The two-stroke internal combustion engine with isolated crankcase as recited in claim 7, wherein:

the group from which the element of the engine containing the vent aperture is selected further consists of an activation passage.

9. The two-stroke internal combustion engine with isolated crankcase as recited in claim 8, further comprising:

a hollow vent tube attached around, communicating with, and leading away from said vent aperture in said activation passage.

10. The two-stroke internal combustion engine with isolated crankcase as recited in claim 3, further comprising:

a pressure ring placed around said piston above and near said piston seal.

11. The two-stroke internal combustion engine with isolated crankcase as recited in claim 2, wherein:

said isolation chamber is connected to said crankcase with an activation passage; and said isolation chamber is connected to the wall of said piston with a transfer passage.

12. The two-stroke internal combustion engine with isolated crankcase as recited in claim 11, wherein:

the group from which the element of the engine containing the vent aperture is selected further consists of an activation passage.

13. The two-stroke internal combustion engine with isolated crankcase as recited in claim 12, further comprising:

a hollow vent tube attached around, communicating with, and leading away from the vent aperture in said activation passage.

14. The two-stroke internal combustion engine with isolated crankcase as recited in claim 11, further comprising:

a pressure ring placed around said piston above and near the said piston seal.

15. The two-stroke internal combustion engine with isolated crankcase as recited in claim 14, wherein:

the group from which the element of the engine containing the vent aperture is selected further consists of an activation passage.

16. The two-stroke internal combustion engine with isolated crankcase as recited in claim 15, further comprising:

a hollow vent tube attached around, communicating with, and leading away from the vent aperture in said activation passage.

17. The two-stroke internal combustion engine with isolated crankcase as recited in claim 2, further comprising:

a pressure ring placed around said piston above and near said piston seal.

18. The two stroke internal combustion engine with isolated crankcase as recited in claim 1, wherein:

said isolation chamber is connected to said crankcase with an activation passage; and said isolation chamber is connected to the wall of said piston cylinder with a transfer passage.

19. The two-stroke internal combustion engine with isolated crankcase as recited in claim 18, wherein the element of the engine containing the vent aperture comprises of an activation passage.

20. The two-stroke internal combustion engine with isolated crankcase as recited in claim 19, further comprising:

a hollow vent tube attached around, communicating with, and leading away from the vent aperture in said activation passage.

21. The two-stroke internal combustion engine with isolated crankcase as recited in claim 18, further comprising:

a pressure ring placed around said piston above and near the said piston seal.

22. The two-stroke internal combustion engine with isolated crankcase as recited in claim 21, wherein:

the group from which the element of the engine containing the vent aperture is selected further consists of an activation passage.

23. The two-stroke internal combustion engine with isolated crankcase as recited in claim 22, further comprising:

a hollow vent tube attached around, communicating with, and leading away from the vent aperture in said activation passage.

24. The two-stroke internal combustion engine with isolated crankcase as recited in claim 1, further comprising:

a pressure ring placed around said piston above and near the said piston seal.

25. The two-stroke internal combustion engine with isolated crankcase as recited in claim 1, wherein:

said pressure-sensitive wall comprises a diaphragm attached to the inner surface of said isolation chamber in such a manner that oil and air cannot pass from the crankcase side of said isolation chamber to the intake side of said isolation chamber.

26. The two-stroke internal combustion engine with isolated crankcase as recited in claim 1, wherein:

said pressure-sensitive wall comprises a bellows attached to the inner surface of said isolation chamber in such a manner that oil and air cannot pass from the crankcase side of said isolation chamber to the intake side of said isolation chamber.

27. The two-stroke internal combustion engine with isolated crankcase as recited in claim 1, wherein:

said pressure-sensitive wall comprises a floating piston, said floating piston being slidably in contact with the inner surface of said isolation chamber so that neither oil nor air can pass between said floating piston and the inner surface of said isolation chamber.

28. A two-stroke internal combustion engine with isolated crankcase, which comprises:

a sealed crankcase having an aperture and a crankshaft;

a piston cylinder attached to said crankcase, said piston cylinder having at the most distant portion of said piston cylinder from said crankcase, a combustion chamber and also having a wall with a transfer port which has a top and a bottom and an exhaust port that has a top and a bottom with the top of the exhaust port being higher than the top of the transfer port;

a piston slidably mounted with said piston cylinder, connected to the crankshaft of said crankcase, and having a top, a bottom, a means for precluding oil pushed by pressurized air from leaving said crankcase and reaching the transfer port and the exhaust port by passing between said piston and the wall of said piston cylinder, and a pressure ring located around said piston near the top of said piston;

an isolation chamber, said isolation chamber having an inner surface, a crankcase side, an intake side, a means for precluding air and oil from passing from the crankcase side to the intake side of said isolation chamber and for pumping air or air and fuel to the combustion chamber, a crankcase-side aperture on the crankcase side of said isolation chamber, an intake aperture on the intake side of said isolation chamber, and a third aperture on the intake side of said isolation chamber, said isolation chamber being attached to said crankcase and communicating with said crankcase through the crankcase-side aperture and the aperture in said crankcase, and said isolation chamber being connected to the wall of said piston cylinder and communicating with said piston cylinder through the third aperture and the transfer port; and a flow regulator connected to said isolation chamber and communicating with said isolation chamber through the intake aperture so that air may pass into, but will not escape from, the intake side of said isolation chamber.

29. A process for producing a two-stroke internal combustion engine with isolated crankcase, which comprises:

attaching a sealed crankcase having an aperture and a crankshaft to a piston cylinder having at the most distant portion of the piston cylinder from said crankcase, a combustion chamber and also having a wall with a transfer port which has a top and a bottom and an exhaust port that has a top and a bottom with the top of the exhaust port being higher than the top of the transfer port;

slidably mounting, within said piston cylinder, a piston having a top, a bottom with a full-length skirt around the entire perimeter of the piston, a piston seal around the piston sufficiently close to the bottom of the piston that the piston seal is always between said crankcase and the bottoms of the transfer port and the exhaust port, and a pressure ring located around said piston near the top of the piston;

connecting the piston to the crankshaft of the crankcase;

attaching to the crankcase an isolating chamber having an inner surface, a crankcase side, an intake side, a pressure-sensitive wall, the pressure-sensitive wall being substantially impervious to air, oil, and the fuels used in an internal combustion engine and the pressure-sensitive wall, together with the inner surface of the isolation chamber, forming a barrier that is substantially impervious to oil, air, and the fuels used in an internal combustion engine, a crankcase-side aperture on the crankcase side of the isolation chamber, an intake aperture on the intake side of the isolation chamber, and a third aperture on the intake side of the isolation chamber, so that the isolation chamber communicates with the crankcase through the crankcase-side aperture and the aperture in the crankcase;

connecting the isolation chamber to the wall of said piston cylinder and communicating with said piston cylinder through the third aperture and the transfer port; and connecting the isolation chamber to a flow regulator so that the isolation chamber communicates with the flow regulator through the intake aperture in order to assure that air may pass into, but will not escape from, the intake side of the isolation chamber.

30. A two-stroke internal combustion engine with isolated crankcase, said engine comprising:

(a) a sealed crankcase, (b) a piston cylinder attached to said crankcase, said piston cylinder having a wall defining a combustion chamber portion, a wall with a transfer port having a top and a bottom, and an exhaust port having a top and a bottom, wherein said top of said exhaust port is higher than said top of said transfer port;

(c) a crankshaft mounted for operation within said crankcase;

(d) a piston slidably mounted within said piston cylinder, said piston operably connected to said crankshaft said piston having a top, a bottom, a piston seal around said piston sufficiently close to said bottom in a location so that said piston seal is always between (1) said crankcase and (2) the bottoms of the transfer port and of the exhaust port, and (e) an isolation chamber, said isolation chamber having an inner surface, a crankcase side, an intake side, a pressure-sensative wall, said pressure-sensitive wall forming a barrier between said crankcase side and said intake side, and being substantially impervious to air, oil, and the fuels used in an internal combustion engine, a crankcase-side aperture on the crankcase side of said isolation chamber, an intake aperture on the intake side of said isolation chamber, and a third aperture on the intake side of said isolation chamber, said isolation chamber communicating with said crankcase through the crankcase-side aperture and the aperture in said crankcase, and said isolation chamber communicating with said piston cylinder through the third aperture and the transfer port; and (f) a flow regulator connected to said isolation chamber and communicating with said isolation chamber through the intake aperture so that air may pass into, but will not escape outward through said flow regulator from the intake side of said isolation chamber.

* * * * *